US012318679B2

(12) United States Patent
Yelovina

(10) Patent No.: US 12,318,679 B2
(45) Date of Patent: Jun. 3, 2025

(54) DEVICE FOR RETAINING A BOOT ON A GLIDING BOARD AND GLIDING APPARATUS COMPRISING SUCH A DEVICE

(71) Applicant: SALOMON S.A.S., Epagny Metz-Tessy (FR)

(72) Inventor: Eddy Yelovina, Epagny Metz-Tessy (FR)

(73) Assignee: SALOMON S.A.S., Epagny Metz-Tessy (FR)

( * ) Notice: Subject to any disclaimer, the term of this patent is extended or adjusted under 35 U.S.C. 154(b) by 61 days.

(21) Appl. No.: 18/207,938

(22) Filed: Jun. 9, 2023

(65) Prior Publication Data

US 2023/0398429 A1 Dec. 14, 2023

(30) Foreign Application Priority Data

Jun. 10, 2022 (FR) ..... 2205597
Apr. 17, 2023 (EP) ..... 23168296

(51) Int. Cl.
*A63C 10/20* (2012.01)
*A63C 10/08* (2012.01)

(52) U.S. Cl.
CPC ..... *A63C 10/20* (2013.01); *A63C 10/08* (2013.01)

(58) Field of Classification Search
CPC ..... A63C 10/20; A63C 10/08; A63C 9/0053; A63C 9/0805; A63C 9/0807;
(Continued)

(56) References Cited

U.S. PATENT DOCUMENTS 2,643,888 A * 6/1953 Hargis, Jr. ..... A63C 9/0844 280/619
7,207,591 B2 * 4/2007 Riedel ..... A63C 9/02 280/611
(Continued)

FOREIGN PATENT DOCUMENTS

EP 0084324 A1 * 7/1983
EP 0694320 B1 * 6/2000
(Continued)

OTHER PUBLICATIONS

EP-3785772-B1 English Translation (Year: 2022).*
(Continued)

*Primary Examiner* — James A Shriver, II
*Assistant Examiner* — Michael T. Walsh
(74) *Attorney, Agent, or Firm* — GREENBLUM & BERNSTEIN, P.L.C.

(57) ABSTRACT

Binding for retaining a boot on a gliding board including a frame, a longitudinal stop that includes an indexer and a first actuation surface, the longitudinal stop being mounted translationally movable in relation to the frame, along a substantially vertical direction, between two configuration positions, namely, an active position for which the indexer is capable of cooperating with a complementary indexer, and an inactive position for which the indexer does not cooperate with the complementary indexer. The binding further includes an actuator that includes a first cam capable of interacting with the first actuation surface of the longitudinal stop so as to cause the translation of the longitudinal stop towards its active position. The actuator is movably mounted only in rotation in relation to the frame.

15 Claims, 7 Drawing Sheets

(58) Field of Classification Search
CPC . A63C 9/08571; A63C 9/08592; A63C 9/086; A63C 9/18; A63C 2009/008
See application file for complete search history.

(56) References Cited

U.S. PATENT DOCUMENTS

| | | | | |
|---|---|---|---|---|
| 9,868,047 | B2 * | 1/2018 | Lapierre | A63C 9/006 |
| 2010/0314854 | A1 * | 12/2010 | Girard | A63C 9/003 280/607 |
| 2023/0398429 | A1 * | 12/2023 | Yelovina | A63C 9/0053 |

FOREIGN PATENT DOCUMENTS

| | | | | |
|---|---|---|---|---|
| EP | 2386333 | A1 * | 11/2011 | A63C 9/005 |
| EP | 3260177 | A1 * | 12/2017 | A63C 9/005 |
| EP | 3511057 | A1 * | 7/2019 | A63C 9/0807 |
| EP | 3 785 772 | A1 | 3/2021 | |
| EP | 3785772 | B1 * | 6/2022 | A63C 5/128 |
| WO | WO-2013124552 | A1 * | 8/2013 | A63C 9/003 |

OTHER PUBLICATIONS

WO-2013124552-A1 English Translation (Year: 2013).*
EP-3260177-A1 English Translation (Year: 2017).*
EP-2386333-A1 English Translation (Year: 2011).*
EP-0084324-A1 English Translation (Year: 1983).*
EP-3511057-A1 English Translation (Year: 2019).*
Preliminary Search Report for French family member Application No. 2205597, and Written Opinion on Patentability, mail date Jan. 30, 2023.

* cited by examiner

DEVICE FOR RETAINING A BOOT ON A GLIDING BOARD AND GLIDING APPARATUS COMPRISING SUCH A DEVICE

CROSS-REFERENCE TO RELATED APPLICATIONS

This application is based upon French Patent Application No. FR 2205597, filed Jun. 10, 2022, and European Patent Application No. EP 231682%, filed Apr. 17, 2023, the disclosures of which are hereby incorporated by reference thereto in their entirety, and the priorities of which are claimed under 35 U.S.C. § 119.

BACKGROUND

1. Field of the Invention

The present invention relates to a device for retaining a boot on a gliding board, as well as a gliding apparatus comprising a gliding board, such as a cross-country ski or alpine touring ski equipped with such a retaining device. Such a retaining device is sometimes referred to as a "stop", "toe piece" or "binding".

2. Background Information

Within the context of the present invention, a gliding apparatus is a piece of equipment on which a person stands while using the apparatus for the practice of a gliding sport, while being fastened to the apparatus via at least one of his boots.

In the field of gliding sports, more particularly cross-country skiing, it is advantageous to be able to adjust the longitudinal position of the skier's boot along the ski.

In the case of classic or alternative cross-country skiing, the ski is cambered and defines a zone under the boot which, by default, is not in contact with the snow. This zone constitutes a "wax pocket". Grip wax can be added in this zone to increase the on-snow traction of the ski to prevent the ski from sliding backwards, which enables the skier to push down more efficiently with the foot. By modifying the longitudinal position of a device for retaining the boot on the ski, it is possible to adjust the contact zone between the ski and the snow as a function of the weight exerted by the skier, giving preference to the gliding or to the grip. When turning, the skier lifts one ski to bring it towards the other ski. In this phase, the lifted ski is connected to the skier only by the front end of the boot, and it is important that the ski is properly balanced. The ski can contact the snow if it bends down forwards or backwards, which may slow down or throw the skier off balance. Lengthwise adjusting of a device for retaining a boot on the ski therefore makes it possible to adjust the balance of the ski in this lifted configuration.

In the case of a skating ski, there is a similar problem of balance when the ski is lifted to be brought towards the other ski in the so-called aerial phases. In addition, when the snow is sticky, the skier may desire a slight rearward imbalance of his skis to lift the front tip by default and thus limit the risk of planting this tip in the snow when moving forward on the snow path. These adjustment possibilities for a skating ski are also obtained due to an adjustment of the longitudinal position of the device for retaining a boot on the ski.

Adjusting the longitudinal position of a binding on a cross-country ski has been described in a plurality of patent applications. This function has in fact been integrated into some commercially available bindings.

For example, the patent document EP3511057 describes a device for retaining a cross-country ski boot, the longitudinal position of which is adjustable in relation to a mounting plate fixed to the ski. The retaining device comprises a frame and a stop element movable in relation to this frame, along a transverse direction, between an active position for which the stop element cooperates with a rack affixed to a mounting plate, and an inactive position for which the stop element no longer cooperates with the rack. The stop element is manually actuatable, directly by the user's finger, but can also be switched from its inactive position to its active position by means of a cam provided on the actuating lever of the mechanism for holding the boot. Thus, when lowered, the lever pushes the stop element into its active position and locks it. The actuating lever is mounted to be rotationally movable in relation to a jaw translationally movable in relation to the frame. By being movable transversely, the stop element can be designed to facilitate the manipulation switching it from an inactive position to an active position, or vice versa. However, this construction requires providing a suitable location for the kinematics of the stop element. Thus, this increases the space requirement of the binding and, consequently, adds to the mass at the front of the binding. Consequently, the positioning of the pivot point between the boot and the gliding apparatus with respect to the balance point of the ski is offset forward, which penalizes the performance of the ski. In addition, this construction does not allow the actuation of the stop element by an actuating means of the retaining device when the boot holding mechanism is in a boot release configuration. The use of an actuating means to act on the stop element enables better ergonomics for adjusting the longitudinal position of the retaining device, particularly with respect to the control of the force to be applied to actuate the stop element.

SUMMARY

The invention provides an alternative and improved device for retaining a boot on a gliding board.

The invention provides particularly a mechanism for adjusting the longitudinal position of a retaining device on a more compact gliding board enabling better balance of the gliding device.

The invention also provides a mechanism for adjusting the longitudinal position of a retaining device on a gliding board that is easy to handle, and in particular without tools.

Further, the invention provides a mechanism for adjusting the longitudinal position of a retaining device on a gliding board, independent of the mechanism for holding the boot, and having simple and reliable kinematics.

The invention provides a device for retaining a boot on a gliding board, the retaining device comprising:

- a frame configured to cooperate with an interface affixed to the gliding board so as to be capable of sliding longitudinally with respect to the gliding board,
- a longitudinal stop element comprising an indexing means and a first actuation surface, the longitudinal stop element being carried by the frame and mounted translationally movable in relation to the frame, along a substantially vertical direction, between two configuration positions:
  - an active position for which the indexing means is capable of cooperating with a complementary indexing means affixed to the gliding board in order to immobilize the retaining device with respect to the gliding board in one of a plurality of predetermined longitudinal positions, and an inactive position for which the indexing means does not cooperate with the complementary indexing means, an actuating means comprising a first cam capable of interacting with the first actuation surface of the longitudinal stop element so as to cause the translation of the longitudinal stop element towards its active position when the actuating means is manipulated along one direction, the actuating means being carried by the frame and movably mounted in relation to the frame between an engagement position for which the first cam acts on the first actuation surface to maintain the longitudinal stop element in its active position and a disengagement position for which the first cam does not act on the first actuation surface to maintain the longitudinal stop element in its active position.

In a particular feature of the invention, the actuating means is movably mounted only in rotation in relation to the frame.

Due to the invention, the retaining device is compact, lightweight, and less bulky. The center of gravity of the binding can be brought rearward and thus not penalize the positioning of the pivot point between the boot and the gliding apparatus in relation to the balance point of the ski. The performance of the gliding apparatus can thus be improved. Being easy to manipulate, the actuating means can be ergonomic due to its kinematics being simple and direct with respect to the frame. Its direct connection with the stop element allows good functioning of the longitudinal immobilization mechanism, with a reliable movement of the stop element, requiring little manipulation effort and actuatable without tools. Furthermore, the actuating means makes it possible to act on the stop element independently of the boot holding mechanism. This construction thus makes it possible to design an actuating means capable of being housed within the actuating lever of the boot holding mechanism so as not to be exposed, nor accessible, when the actuating lever is lowered.

According to advantageous but not essential aspects of the invention, such a retaining device may incorporate one or more of the following characteristics, taken in any technically acceptable combination:

The frame carries a holding mechanism configured to cooperate with a fastening element belonging to the boot, so that the boot is held in position in relation to the frame, and the actuating means is a component distinct from the components of the holding mechanism. According to one embodiment, the holding mechanism is designed to enable the fastening element to be affixed to the retaining device while allowing the rotation of the boot about an axis Y1 transverse to the retaining device.

The holding mechanism comprises an actuating lever sized to cover the longitudinal stop element and the actuating means when the boot is held in position in relation to the frame.

The actuating means comprises a gripping plate and at least one radial extension extending from the plate towards the axis of rotation of the actuating means, the radial extension carrying the first cam. According to one embodiment, the actuating means comprises two parallel radial extensions, spaced from one another along a transverse direction. According to one embodiment, the median plane of the gripping plate and the median plane of the frame are substantially merged when the retaining device is assembled.

The longitudinal stop element comprises a second actuation surface and is characterized in that the actuating means comprises a second cam capable of interacting with the second actuation surface of the longitudinal stop element so as to cause the translation of the longitudinal stop element towards its inactive position. According to one embodiment, the second actuation surface is opposite the first actuation surface. According to one embodiment, at least one radial extension carries the second cam.

The indexing means is sized and arranged so that, when the longitudinal stop element switches to its inactive position, the indexing means retracts into the frame.

The translation of the longitudinal stop element in relation to the frame is guided by the cooperation between a pivot shaft of the actuating means and an oblong opening of the longitudinal stop element.

The displacement of the longitudinal stop element is achieved solely by the action of the actuating means, without the longitudinal stop element being biased by any elastic means.

The longitudinal stop element is coupled to an elastic means interposed between the longitudinal stop element and the frame, or a part affixed to the frame so as to cause the displacement of the longitudinal stop element from its active position to its inactive position, or vice versa.

The invention also relates to a gliding apparatus comprising a gliding board and a retaining device as defined above.

BRIEF DESCRIPTION OF DRAWINGS

Other characteristics and advantages of the invention will be better understood from the detailed description that follows, with reference to the annexed drawings illustrating, by way of non-limiting embodiments, how the invention can be carried out, and in which.

DETAILED DESCRIPTION

Figure 1:
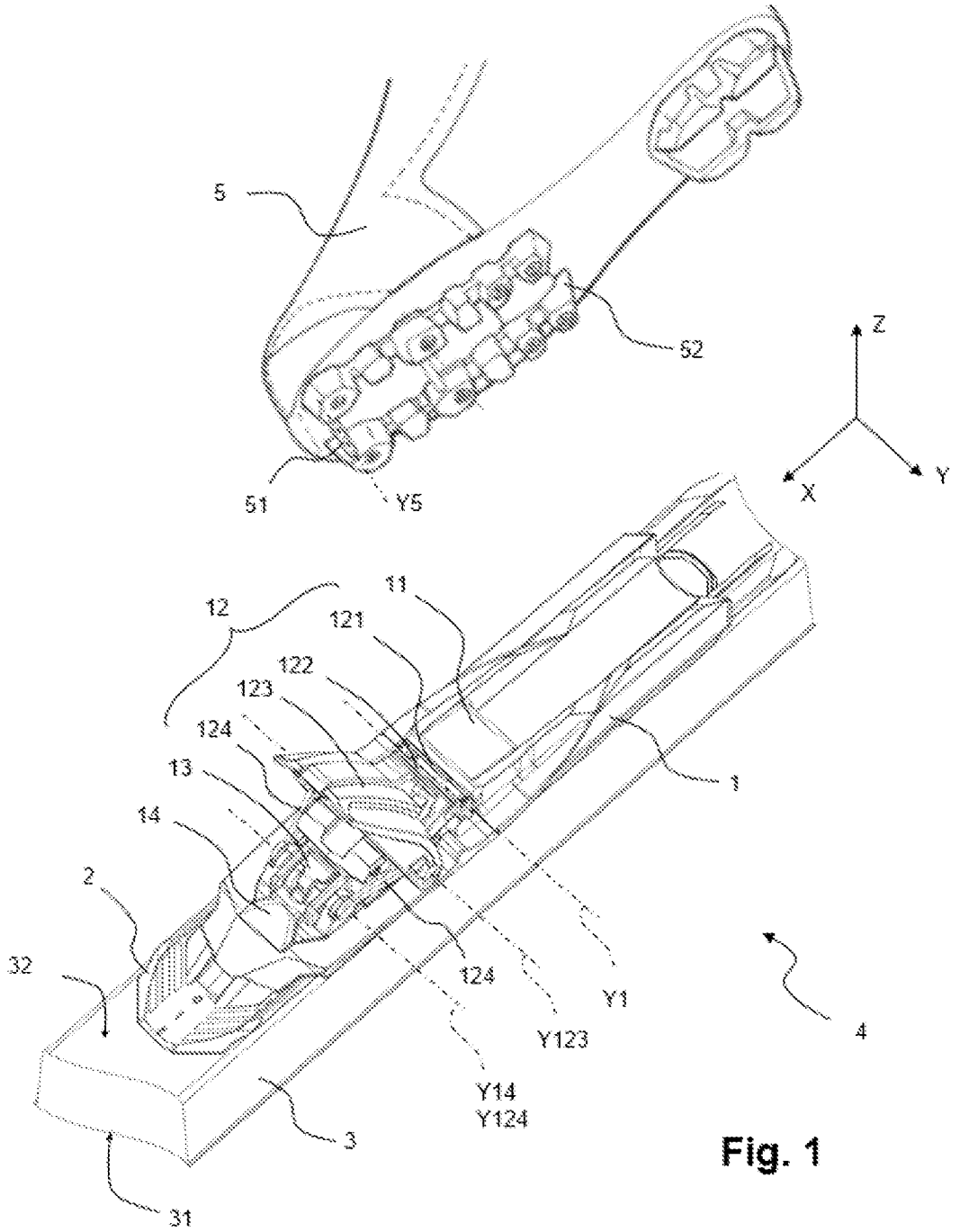
FIG. 1 is a perspective front view of a portion of a gliding apparatus equipped with a retaining device according to the invention, in a first use configuration.
Figure 2:
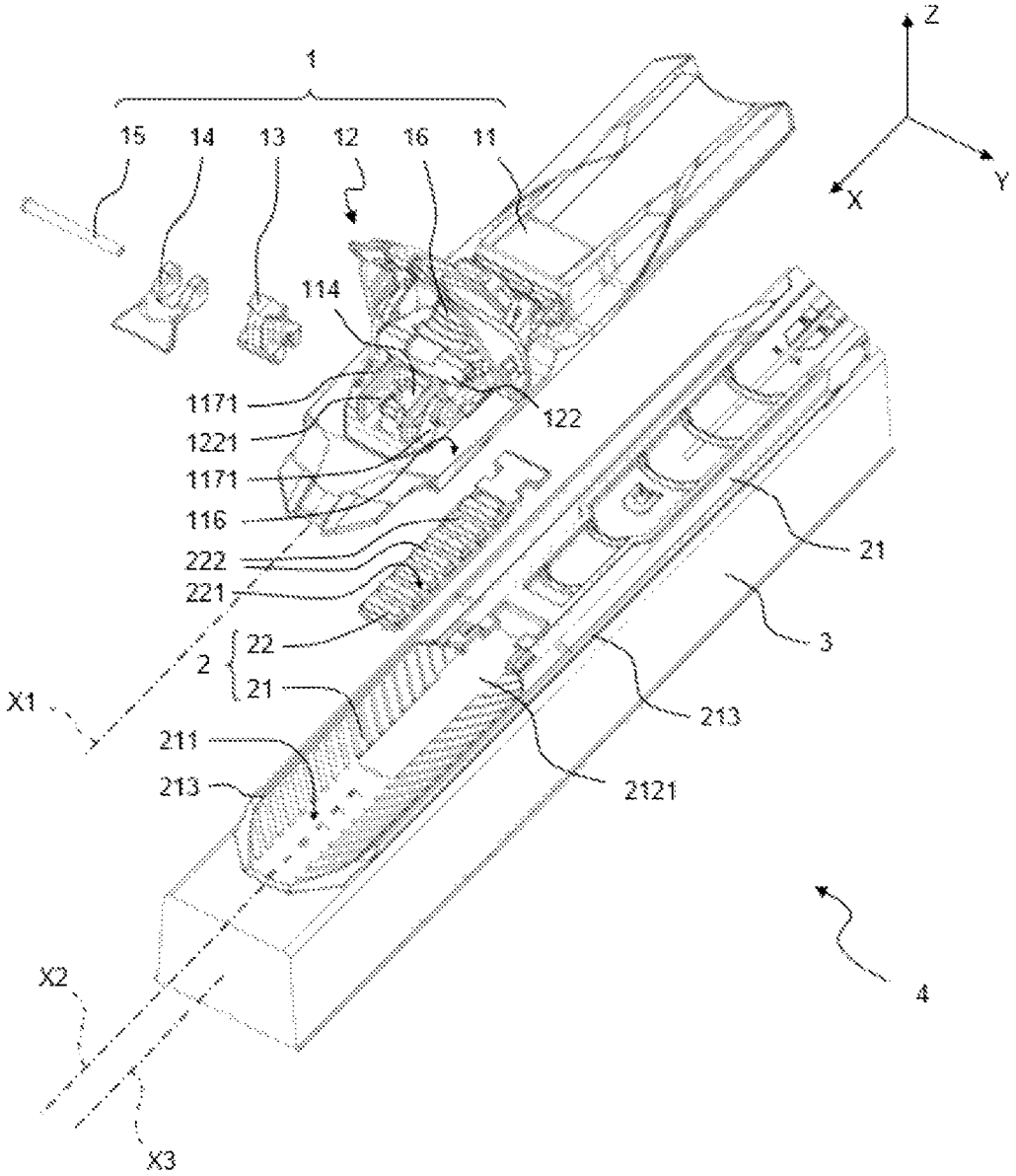
FIG. 2 is an exploded view of the retaining device illustrated in FIG. 1.
Figure 3:
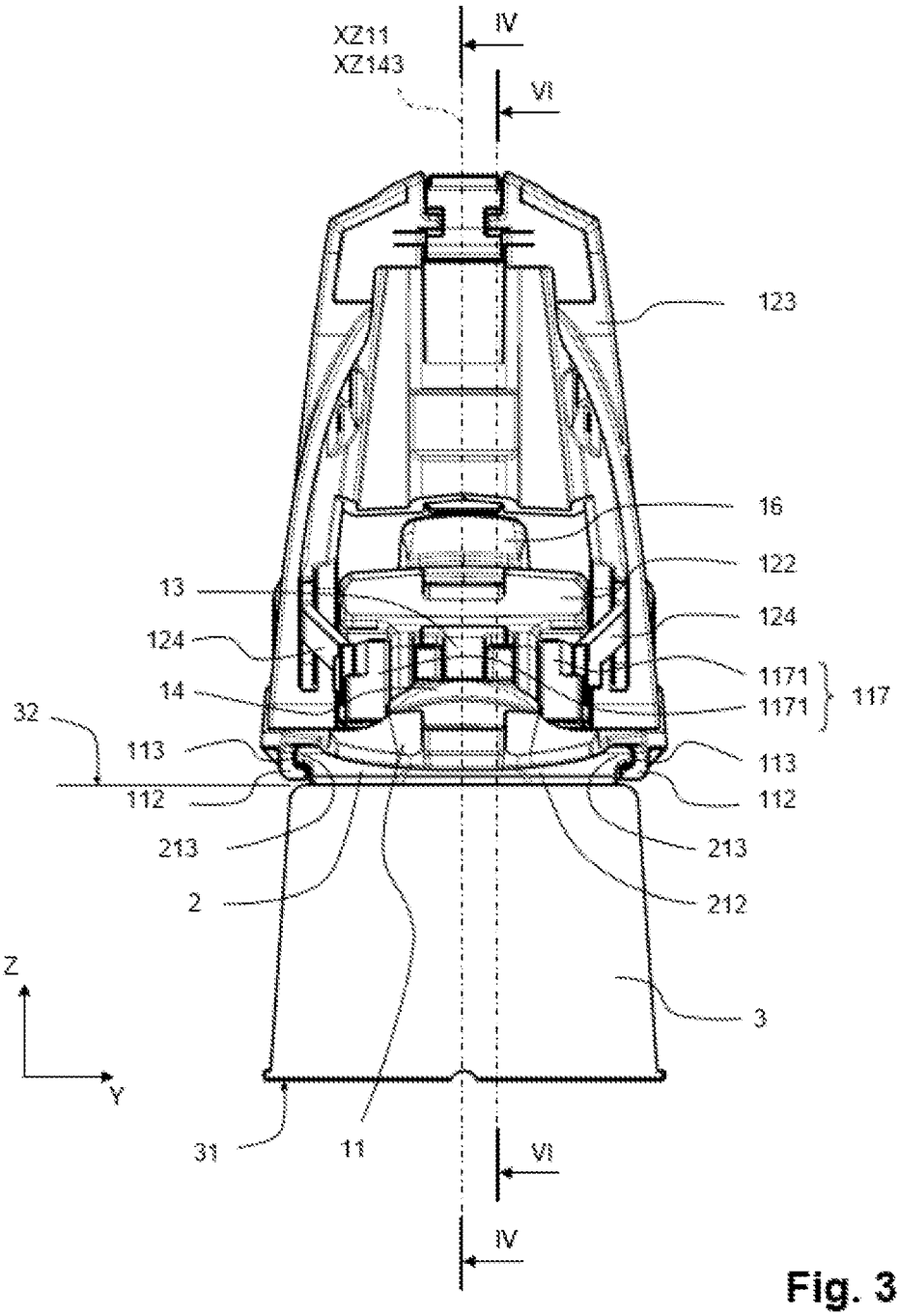
FIG. 3 is a front view of the retaining device illustrated in FIG. 1.

The following of the description makes use of terms such as "horizontal", "vertical", "transverse", "upper", "lower", "lateral", "top", "bottom", "right", "left", "forward", "rearward", "front", "back". These terms should be considered as relative terms in relation to the normal position occupied by the gliding apparatus when the user uses it on a substantially flat track.

A reference point is also used, of which the rearward/forward direction corresponds to the X axis, the transverse or right/left direction corresponds to the Y axis, and the vertical or bottom/top direction corresponds to the Z axis.

Furthermore, certain directions in the description are qualified in relation to a frame of reference. In order not to limit the interpretation, the term "substantially" is used to specify that the invention also relates to an angular variation of this direction of plus or minus 15° with respect to this qualification.

The invention relates to a device 1 for retaining a boot 5, also referred to as a binding, intended to be assembled to an interface 2, or mounting plate, affixed to a gliding board or ski 3. According to one embodiment, the interface 2 and the gliding board 3 form a unitary, one-piece element. Alternatively, as illustrated below, the interface 2 is a separate component fixed to the upper surface 32 of the gliding board 3, opposite its gliding surface 31. The gliding board 3 extends along a longitudinal axis X3. The retaining device 1 is mounted with the possibility of sliding in relation to the ski 3, along its longitudinal axis X3. The assembly comprised of the retaining device 1, the interface 2, and the gliding board 3 forms a gliding apparatus 4.

The invention relates more particularly to a gliding apparatus intended for the practice of cross-country skiing or ski touring. Such a gliding apparatus is equipped with a retaining device designed to affix the front of the boot to the gliding board. Thus, the retaining device does not affix the heel of the boot to the gliding board. The skier can then freely lift his/her heel, without lifting the ski. The gliding apparatus can nevertheless comprise a guide ridge arranged so as to limit the lateral displacement of the heel when it cooperates with the guide ridge, when the heel rests on the ski.

The interface 2 is fixed to the ski 3 so that the longitudinal axis X3 of the ski and the longitudinal axis X2 of the interface are parallel. In this example, the interface 2 comprises an insert 22 and a main body 21 comprising a central portion 212 and two lateral wings 213 extending on either side of the central portion 212. The outer edge of each lateral wing 213 forms a lateral rail extending along a direction parallel to the longitudinal axis X2 of the interface. The main body 21 has an upper surface 211. The assembly of the main body 21 to the ski 3 is carried out by any appropriate means. This can be achieved by gluing or screws. In its central portion 212, the main body 21 comprises a housing 2121 intended to receive an insert 22. The insert 22, like the main body 21, is a component of the interface 2. The insert 22 comprises an upper surface 221 and a series of notches 222 extending from the upper surface 221. The flanks of each notch are preferably inclined so that the base of the notch is thicker. The thickness E222 at the top is preferably greater than two millimeters. The height H222 of a notch is preferably greater than two millimeters. As we will be seen below, the series of notches 222 form a complementary indexing means 20 intended to cooperate with an indexing means 131 of a longitudinal stop element 13 so as to be capable of immobilizing the retaining device along the gliding board, in one of a plurality of predetermined positions. When the insert 22 is assembled on the central portion 212 of the main body 21, each notch 222 extends along a vertical axis Z, in the direction of the retaining device. All the notches 222 are aligned along a longitudinal direction X parallel to the longitudinal axis X2 of the mounting plate. In use, the notches 222 are strongly biased because they are the ones holding the retaining device in position, along the longitudinal direction. Thus, it is preferable to select a suitable material for these notches. The proposed construction involving attaching a removable insert has several advantages. This enables the part to be replaced if the notching is damaged, on the one hand, and more rigid material to be used locally, where necessary, without penalizing the weight of the interface and, therefore, of the ski, on other hand. For example, the insert can be made of reinforced polymer or metal while the remainder of the interface is made of unfilled plastic. The insert can be removably mounted on the interface by any appropriate means. This can be achieved by clipping or using a screw. This solution can be transposed to any type of indexing of a system for adjusting the longitudinal position of a retaining device in relation to a ski and is therefore not limited to the embodiment illustrated here. For example, the indexing means 131 and the complementary indexing means 20 can be obtained by one or more pins cooperating with holes. The series of notches 222 can be replaced by a series of housings, indents, recesses corresponding to the gap between two notches. The notches are not necessarily rectilinear along a transverse direction.

According to one embodiment, the interface 2 comprises connecting means making it possible to keep the insert 22 and the main body 21 affixed to one another, along all directions, once the two parts have been assembled. These connecting means can be removable to allow replacement of the insert, if necessary. According to a variant, these connecting means cannot be dismounted without damaging the interface.

In an alternative embodiment, the complementary indexing means 20 and the interface 2 form a unitary, single-piece part. For example, the notches 222 are made directly in the central portion 212 of the main body 21 and not on an attached insert 22. Advantageously, the notches 222 are made of a material other than that of the main body 21. In this case, the notches 222 are provided on an insert 22 which is overmolded on the main body 21. The assembly comprised of the main body 21 and the overmolded insert 22 then forms the interface 2. As mentioned above, the use of two different materials between the insert and the remainder of the interface makes it possible to locally reinforce the interface, in the location where it is necessary, for example in the area of the transmission of the longitudinal forces. Furthermore, this makes it possible, for example, to use a material suitable for gluing the interface to the ski in the area of the contact zone between the interface and the ski, for example the main body 21 of the interface. According to one embodiment, the overmolded insert 22 is made of reinforced polymer while the remainder of the interface 2, namely the main body 21, can be made of unfilled polymer.

According to an embodiment mentioned above, the interface 2 is glued to the upper surface 32 of the gliding board 3. This can be achieved by separate gluing of the constituent parts of the interface, the insert 22, on the one hand, and the main body 21, on the other hand. Alternatively, this can be achieved by simultaneous gluing of the constituent parts of the interface, either with a unitary interface, the interface then being single-material or overmolded multi-material, or with a previously assembled interface, the insert then already being affixed to the main body via connecting means.

The interface 2 is arranged between the gliding board 3 and the retaining device 1. It carries the complementary indexings 20.

According to the embodiment described, the retaining device 1 is a cross-country ski binding and comprises a frame 11, a mechanism 12 for holding in position a fastening element 51 belonging to the boot 5, a longitudinal stop element 13, a means 14 for actuating the longitudinal stop element, and a return means 16 for bringing the heel of the boot closer to the ski.

The frame 11 is designed to be assembled to the interface 2. It extends along a longitudinal axis X1 substantially parallel to the longitudinal axis X2 of the interface when the frame is mounted on the interface. The frame comprises a lower surface 111 intended to be opposite the upper surface 211 of the interface 2. The lower surface 111 is demarcated laterally by two flanges 112, extending along a vertical axis Z, in the direction of the interface, from the lower surface. Each flange 112 includes an inner lateral groove 113 oriented along a longitudinal direction parallel to the longitudinal axis X1 of the frame. The two inner lateral grooves 113 are opposite one another. Each inner lateral groove 113 is intended to cooperate with a respective rail formed by one of the lateral wings 213 of the interface 2 so as to guide the frame in translation in relation to the interface, along a longitudinal direction X. This cooperation also allows maintaining the in relation position between the frame and the interface along a direction Z, normal to the upper surface of the interface. This cooperation thus defines a slide-type connection between the frame and the interface ensuring the longitudinal sliding of the retaining device with respect to the ski. Other longitudinal guiding solutions could be envisioned.

Conventionally, the frame 11, in its upper portion, carries the mechanism 12 for holding in position a fastening element 51 belonging to the boot 5. In the illustrated embodiment, the fastening element 51 is a transverse shaft integrated in a recess in the front of the sole 52 of the boot 5, extending along a transverse direction Y5. In practice, the boot 5 can conform to the technical teaching of the patent applications EP-A-0 913102 and/or EP-A-0 913 103, to which reference can be made for more details. To ensure the affixation of the boot to the retaining device, the holding mechanism 12 comprises a fixed jaw 121, a movable jaw 122, an actuating lever 123, and connecting rods 124. The operation is similar to that of the binding described in the patent document FR-A-2638974.

The fixed jaw 121 can be an attached part, fixed to the frame 11. It can be made of metal or with a material suitable for resisting friction and stresses between the fixed jaw and the fastening element 51 of the boot. Alternatively, the fixed jaw 121 can be a portion of the frame 11. In this case, the fixed jaw and the frame form a unitary, single-piece part.

Figure 4:
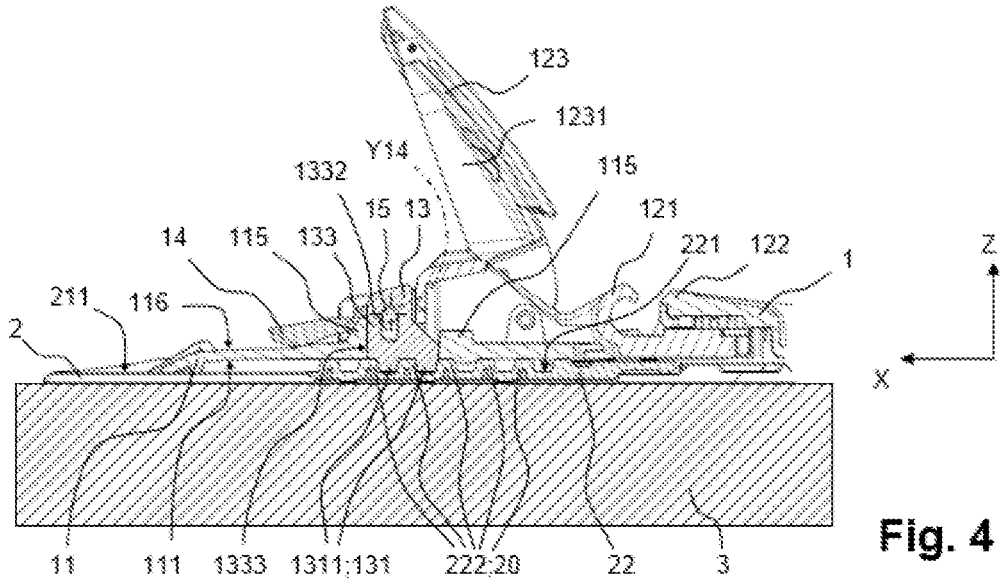
FIG. 4 is a cross-sectional view along the line IV-IV of FIG. 3 of the gliding apparatus illustrated in FIG. 1, in the first use configuration.
Figure 5:
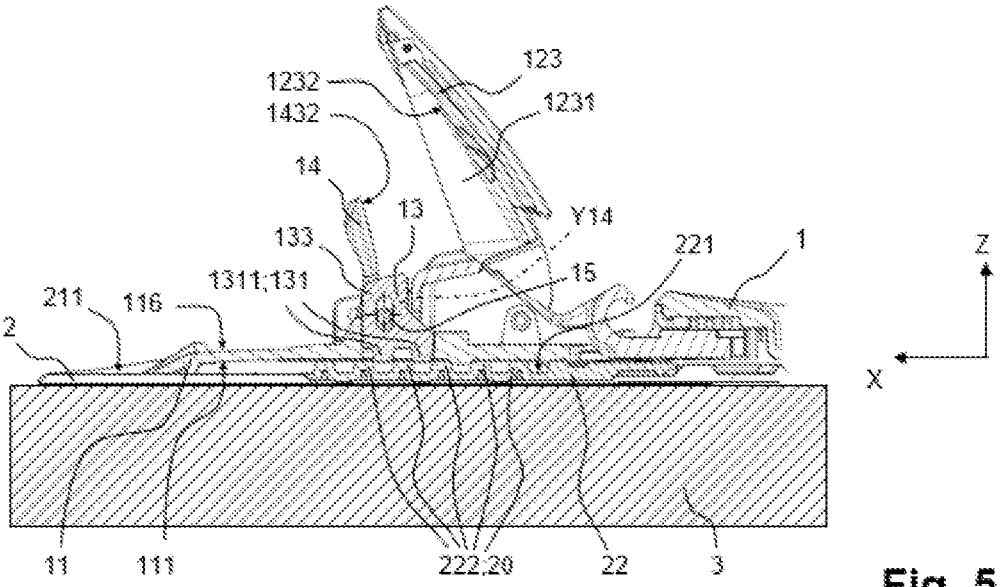
FIG. 5 is a cross-sectional view along the line IV-IV of FIG. 3 of the gliding apparatus illustrated in FIG. 1, in a second use configuration.
Figure 6:
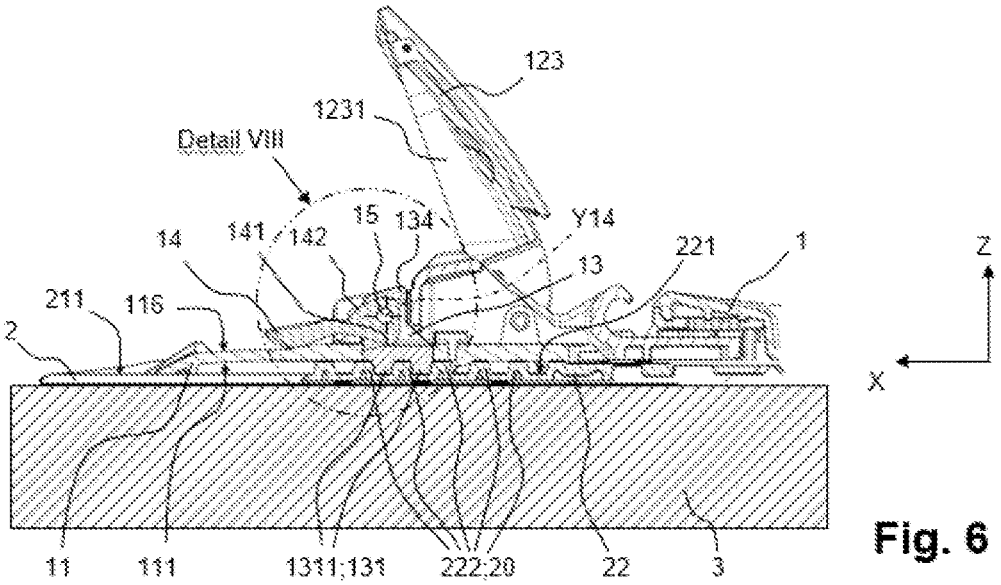
FIG. 6 is a cross sectional view along the line VI-VI of FIG. 3 of the gliding apparatus illustrated in FIG. 1, in the first use configuration.
Figure 7:
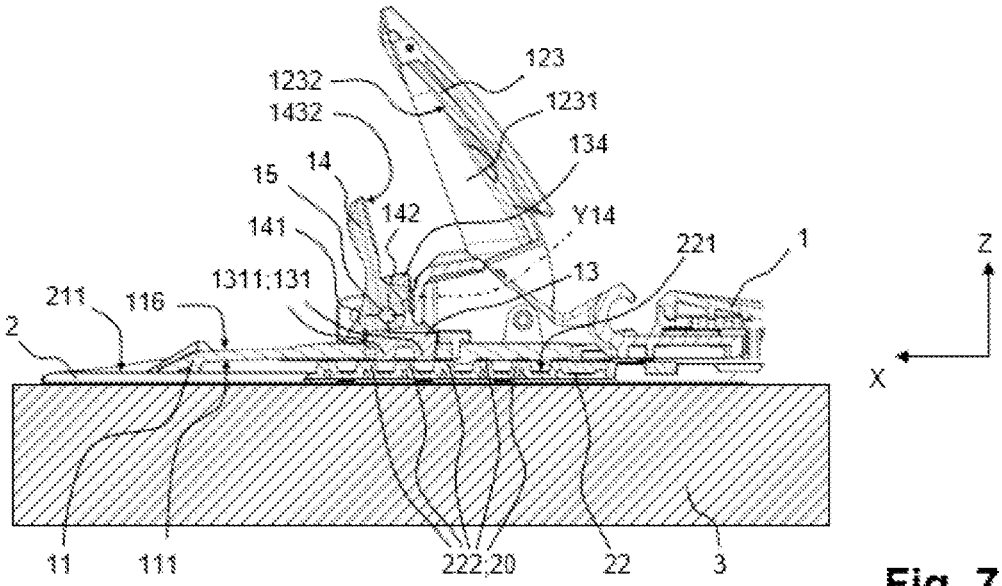
FIG. 7 is a cross-sectional view along the VI-VI of FIG. 3 of the gliding apparatus illustrated in FIG. 1, in the second use configuration.

The movable jaw 122 is designed to move between an engagement position and a release position. When in its engagement position, the movable jaw 122 is capable of cooperating with the fixed jaw 121 so as to form an interstitial space intended to receive the fastening element 51 as detailed below. This arrangement enables the fastening element to be affixed to the retaining device while allowing the rotation of the boot about an axis Y1 transverse to the retaining device. When in its release position, as shown in FIGS. 4 to 7, the movable jaw 122 is spaced away from the fixed jaw 121 so as to create an upper passage for the fastening element 51, so that it can disengage from the interstitial space previously defined. This configuration enables the fastening element to be separated from the retaining device.

In this example, when the movable jaw 122 moves from its release position to its engagement position, the movable jaw 122 comes closer to the fixed jaw 121, so that the movable jaw and the fixed jaw form substantially a cylinder capable of receiving the fastening element 51 therewithin, whereby the latter can freely pivot about the axis Y1 of the cylinder formed. In this case, the axis Y5 of the fastening element 51 and the axis Y1 of the cylinder formed are substantially aligned. Thus, the fixed jaw 121 is arranged so that the fastening element 51 is positioned between the movable jaw 122 and the fixed jaw 121 when the boot 5 is engaged with the retaining device 1. Conversely, when the movable jaw 122 moves from its engagement position towards its release position, the movable jaw 122 moves away from the fixed jaw 121 so as to create an opening between the two jaws, through which the fastening element 51 can pass. In this example, the mobile jaw 122 is positioned in front of the fixed jaw 121 on the frame 11.

The actuating lever 123 is in the form of a cover pivotally mounted on the body of the movable jaw 122 about a transverse axis Y123. Each lateral edge of the actuating lever 123 is connected to a front portion 117 of the frame 11 forming a yoke by a connecting rod 124. A first end of the connecting rod is rotatably mounted on the front portion of the frame, about a transverse axis Y124, parallel to the pivot axis Y123 of the actuating lever. A second end of the connecting rod is rotatably mounted on a lateral edge of the actuating lever, about a transverse axis Y124, parallel to the pivot axis Y123 of the actuating lever 123.

To switch the movable jaw from its engagement position to its release position, or vice versa, the user acts on the actuating lever 123. Lowering the actuating lever 123 causes the displacement of the movable jaw 122 towards its engagement position.

Conversely, lifting the actuating lever causes the displacement of the movable jaw to switch from its engagement position to its release position. In this example, the actuating lever 123 is designed so that, when completely lowered, it comes to bear against an upper front surface 116 of the frame 11. In this configuration, the movable jaw is in its engagement position.

In this example, this control device is designed to ensure locking of the movable jaw in the engagement position. Thus, when the actuating lever is completely raised, the movable jaw is in its release position. Lowering the actuating lever by a predetermined angle brings the movable jaw to its engagement position. Then, by rotating the actuating lever until it comes to bear against an upper front surface 116 of the frame 11, the movable jaw is locked in its engagement position and can no longer move longitudinally, along to direction X, without action on the actuating lever.

The actuating lever 123 forms a cover incorporating a lower recess 1231 which, together with the upper front surface 116 of the frame 11 and a portion of the body of the movable jaw 122, is provided to form a substantially closed volume when the actuating lever 123 rests on the upper front surface 116 of the frame 11. Thus, in this configuration, the actuating lever 123 makes it possible to protect the elements housed in this cavity from external elements, such as snow or ice. The connecting rods 124 are arranged to be housed in this cavity when the actuating lever 123 is lowered, i.e., when the retaining device is engaged.

According to one embodiment, the return means 16 making it possible to bring the heel of the boot closer to the ski is an elastic buffer carried by the body of the movable jaw 122. The elastic buffer 16 is designed to take support against a front surface of the sole when the user lifts his heel. A return means of this type is illustrated in the patent document FR-A-2638974.

Figure 8:
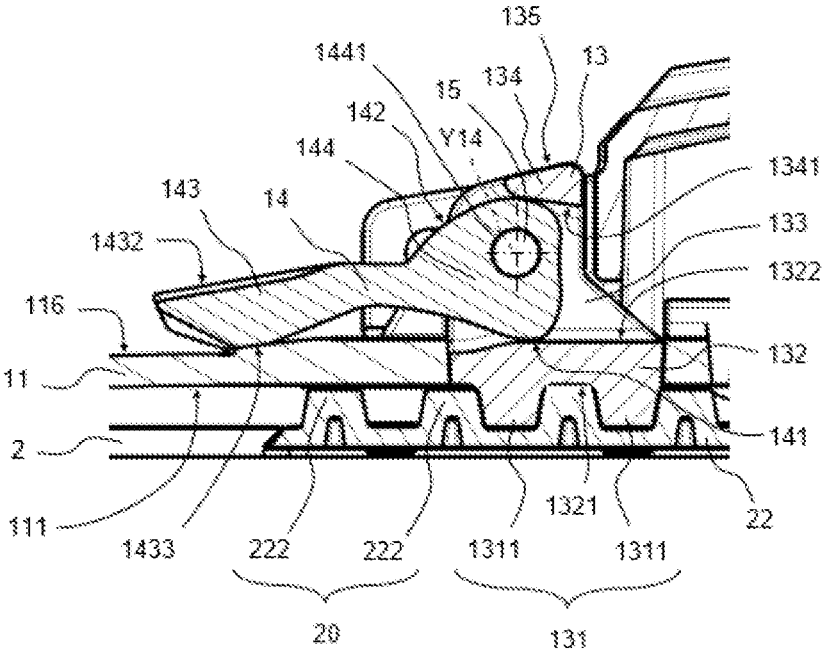
FIG. 8 is a detail view VIII of FIG. 6.
Figure 9:
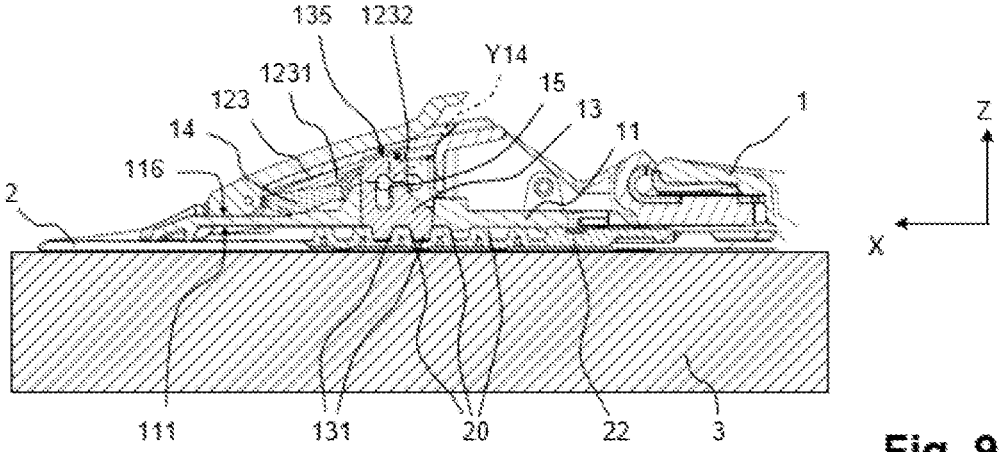
FIG. 9 is a cross-sectional view along the line VI-VI of FIG. 3 of the gliding apparatus illustrated in FIG. 1, in the first use configuration, with the actuating lever folded down.
Figure 10:
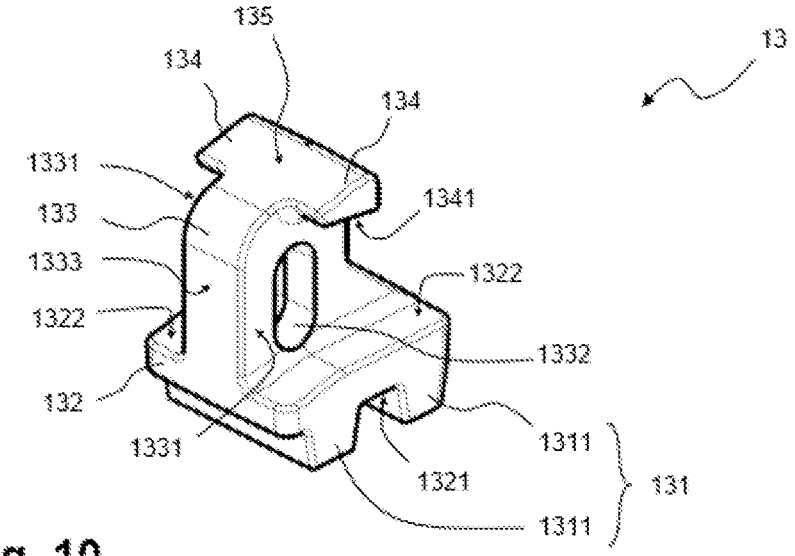
FIG. 10 is a perspective view of a longitudinal stop element of the retaining device according to the invention.
Figure 11:
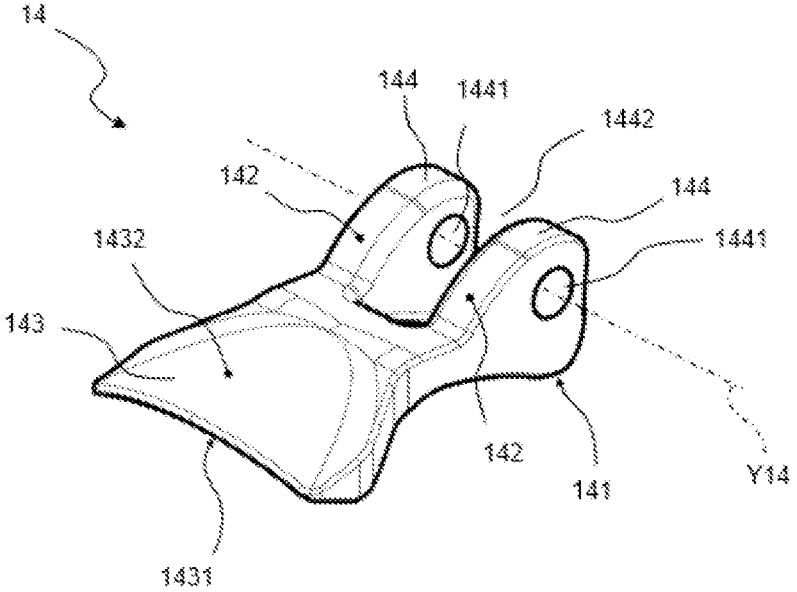
FIG. 11 is a perspective view of an actuating means of the retaining device according to the invention.

According to the invention, the retaining device comprises a longitudinal stop element 13 comprising an indexing means 131 and a first actuation surface 1322. The longitudinal stop element 13 is carried by the frame 11. It is mounted translationally movable in relation to the frame, between two configuration positions. The first configuration position is an active position, shown in FIGS. 4, 6, 8, and 9, for which the indexing means 131 is capable of cooperating with a complementary indexing means 20 affixed to the gliding board to immobilize the retaining device in relation to the gliding board in one of a plurality of predetermined longitudinal positions. The second configuration position is an inactive position, shown in FIGS. 5 and 7, for which the indexing means 131 does not cooperate with the complementary indexing means 20.

In this example, the longitudinal stop element 13 comprises a plate 132 having a lower surface 1321 and an upper surface 1322. The upper surface here corresponds to the first actuation surface 1322 mentioned above.

The indexing means 131 extends from the lower surface 1321 of the plate. Here, the indexing means 131 forms two notches 1311 extending along a transverse direction Y, over the entire width of the plate. The flanks of each notch 1311 are preferably inclined so that the base of the notch is thicker. This beveling, associated with the beveling of the notches 222 of the insert 22, makes it possible to facilitate the positioning and the cooperation of the notches 1311, 222, in other words, between the indexing means 131 and the complementary indexing means 20. The thickness E1311 at the top is preferably greater than two millimeters. The height H1311 of a notch is preferably greater than two millimeters. Alternatively, the indexing means 131 can comprise only one or more notches 1311. The notches can take different shapes or different dimensions.

The longitudinal immobilization of the retaining device with respect to the gliding board is achieved due to the cooperation between the indexing means 131 of the longitudinal stop element 13 and the complementary indexing means 20 of the interface 2. The indexing means 131 comprises at least one index which, in this example, is comprised of two notches 131. The complementary indexing means 20 comprises a plurality of housings for the index (es); in this example, the housing corresponds to the interstitial space between two successive notches 222 of the insert 22. The housings are aligned along a longitudinal direction X to allow the longitudinal adjustment of the retaining device in relation to the gliding board in one of a plurality of predetermined longitudinal positions. Thus, each housing defines a predetermined longitudinal position.

In addition, to facilitate the adjustment of the longitudinal position of the retaining device, the frame may include one or more reference points intended to cooperate with one or more respective graduations provided on the upper surface of the interface. Thus, the user has a visual reference point to determine the exact longitudinal position of the frame in relation to the interface. Other embodiments of this visual indicator can be envisioned.

In its upper portion, the longitudinal stop element 13 comprises a central rib 133, having a thickness E133, between two lateral surfaces 1331, the central rib extending from the first actuation surface 1322, along a median sagittal plane XZ. Thus, the central rib divides the first actuation surface 1322 into two lateral portions arranged on either side of the central rib. The central rib comprises a through oblong opening 1332 in the direction of its thickness. The oblong opening 1332 thus opens out onto each lateral surface 1331 of the central rib. The oblong opening 1332 is oriented along a vertical direction Z. The central rib also comprises a vertical planar front surface 1333 extending substantially over the entire height of the central rib. Furthermore, the central rib comprises two upper extensions 134. Each of these extensions 134 extends from the upper portion of a lateral surface 1331 of the central rib. Each extension 134 then extends along a transverse direction Y, over a height H134 preferably greater than two millimeters. Each extension 134 has a lower surface 1341, opposite the first actuation surface 1322. Thus, the lower surface 1341 is positioned above the first actuation surface 1322. These two lower surfaces 1341 of the extensions 134 form a second actuation surface 1341. Thus, the projection on a frontal plane YZ of the sub-assembly comprised of the plate 132, the central rib 133 and its two extensions 134 substantially form an "I" shape (similar to the cross-section of an IPN or IPE beam).

According to the invention, the longitudinal stop element 13 is translationally movable along a substantially vertical direction Z. Thus, when the longitudinal stop element 13 is in its active position, the indexing means 131, here the notches 1311, is designed to project from the lower surface 111 of the frame 11. Conversely, when the longitudinal stop element 13 is in its inactive position, the indexing means 131, here the notches 1311, is designed to be flush with or set back from the lower surface 111 of the frame 11. In other words, the indexing means 131 is dimensioned and arranged so that, when the longitudinal stop element 13 switches to its inactive position, the indexing means 131 retracts into the frame, it rises so as to no longer project from the lower surface 111 of the frame 11. Thus, the frame 11 can slide more freely along the interface 2. With a retractable indexing means 131, the retaining device is compatible with an optimized interface, having a small thickness. This makes it possible to lighten the gliding apparatus, to have a more flexible interface which adapts better to the camber of the ski. The performance of the gliding apparatus is improved. Contrary to the cited prior art, this construction no longer requires a groove in the front portion of the interface for the passage of the stop element, because, here, the stop element no longer risks interfering with a portion of the interface when the frame slides along the interface. However, due to being exposed, this groove can thus be damaged or clogged, which can impede the translation of the frame during its assembly with or disassembly from the interface. This groove also causes water or snow penetration in the area of the stop element, which can block its kinematics, especially if the water freezes or the snow compacts. Furthermore, this solution makes it possible to protect the indexing means 131 while handling the unmounted binding when the longitudinal stop element is in its inactive position.

In this example, the frame comprises a through opening 114 heightwise, along a direction Z, opening out on one side onto the lower surface 111 of the frame and on the other side onto an upper surface 116 of the frame. The through opening 114 is intended to house the longitudinal stop element 13, and more particularly to guide the vertical translation of the longitudinal stop element 13 in the area of its plate 132. Consequently, the dimensions of the peripheral edges of the through opening 114 correspond substantially to the dimensions of the peripheral edges of the plate 132 of the longitudinal stop element 13, except for operating clearance. The peripheral edges of the through opening 114 constitute a guide means. The peripheral edges of the plate 132 of the longitudinal stop element 13 constitute a complementary guide means. This guide means is thus capable of cooperating with the complementary guide means so as to guide the translation of the longitudinal stop element 13 with respect to the frame 11. To further improve the guiding and to prevent the longitudinal stop element 13 from tilting when it moves, the frame 11 may comprise upper vertical extensions 115 extending upwards from the upper surface 116 of the frame 11. These upper vertical extensions 115 comprise a surface or a generatrix substantially in the same plane as one of the peripheral edges of the through opening 114. These extensions 115 are capable of cooperating with the peripheral edges of the plate 132 or the vertical planar front surface 1333 of the longitudinal stop element 13 so as to guide the translation of the longitudinal stop element 13 in relation to the frame 11. These extensions 115 also constitute a guide means, as defined above. Similarly, the vertical planar front surface 1333 of the longitudinal stop element 13 also constitutes a complementary guide means, as defined above.

According to the invention, the retaining device comprises an actuating means 14 designed and arranged to interact with the longitudinal stop element 13. The actuating means 14 is carried by the frame 11. It comprises a first cam 141 capable of interacting with the first actuation surface 1322 of the longitudinal stop element 13 so as to cause the translation of the longitudinal stop element 13 towards its active position when the actuating means 14 is manipulated along one direction. The actuating means 13 is mounted movably in relation to the frame 11 between an engagement position for which the first cam 141 acts on the first actuation surface 1322 to maintain the longitudinal stop element 13 in its active position, and a disengagement position for which the first cam 141 does not act on the first actuation surface 1322 to maintain the longitudinal stop element 13 in its active position.

According to the invention, the actuating means 14 is mounted movably only in rotation in relation to the frame 11 about an axis of rotation Y14 substantially transverse to the frame 11. The use of a pivoting lever is common for a binding of this type. The kinematics is simple and similar to that of the actuating lever 123 of the boot holding mechanism 12, which makes it ergonomic.

According to one embodiment, the actuating means 14 comprises a gripping plate 143 and at least one radial extension 144 extending from the plate towards the axis of rotation Y14 of the actuating means 14. The radial extension 144 carries the first cam 141.

In this example, the gripping plate 143 comprises a lower surface 1431 and an upper surface 1432, provided for the manipulation of the actuating means 14. Thus, using his finger, the user presses on the upper surface 1432 to switch the actuating means 14 to its engagement position illustrated in FIGS. 4, 6, 8, and 9. Conversely, the user presses on the lower surface 1431 to switch the actuating means 14 to its disengagement position illustrated in FIGS. 5 and 7. Here, the gripping plate 143 is extended in the area of one edge by two parallel extensions 144, spaced from one another, along a transverse direction Y. Thus, a central recess 1442 is created between the two radial extensions 144. The end of each radial extension 144 comprises a hole 1441 that is through transversely, in the thickness-wise direction of the extension, along a direction Y. These two through holes 1441 have substantially the same diameter and are substantially aligned on a transverse axis Y14 corresponding to the axis of rotation of the actuating means. The two through holes 1441 are intended to receive a pivot shaft 15 mounted on a front portion 117 of the frame 11 forming a yoke. The two walls 1171 of the yoke extend upwards from the upper surface 116 of the frame 11. They are arranged and spaced from one another so that the two radial extensions 144 can be housed therebetween. The end of each radial extension 144 also includes the first cam 141, in its lower portion, and a second cam 142 in its upper portion. The dimensioning of the through hole 1441 of the first cam 141 and of the second cam 142 is identical for the two radial extensions 144. The projection of the first 141 and second 142 cams of a radial extension 144*a* on the median sagittal plane XZ of the actuating means 14 substantially merges with the projection of the first 141 and second 142 cams of the other radial extension 144*b* on the median sagittal plane XZ of the actuation means 14. When the actuating means 14 is assembled to the frame 11, the median plane XZ143 of the gripping plate 143 and the median plane XZ11 of the frame 11 are substantially merged.

The frame 11, the longitudinal stop element 13 and the actuating means 14 are dimensioned and arranged so that the actuating means 14 can interact with the longitudinal stop element 13 so as to displace the longitudinal stop element 13 with respect to the frame 11 along a vertical translation Y. This arrangement is provided so that the first cam 141 of the actuating means 14 is capable of interacting with the first actuation surface 1322 of the longitudinal stop element 13 so as to cause the translation of the longitudinal stop element 13 towards its active position. Similarly, this arrangement is provided so that the second cam 142 of the actuating means 13 is capable of interacting with the second actuation surface 1341 of the longitudinal stop element 13 so as to cause the translation of the longitudinal stop element 13 towards its inactive position.

Thus, when the user lowers the actuating means 14, the first cam 141 comes into contact with the first actuation surface 1322, and then pushes the longitudinal stop element 13 towards its active position. During this phase, the second cam 142 moves away from the second actuation surface 1341 so as to no longer be in contact. In this configuration, the gripping plate 143 comes into contact with the upper front surface 116 of the frame 11. The lowering of the actuating means 14 involves rotating the actuating means 14 about its axis of rotation Y14, in an engagement direction, to make it switch from its disengagement position to its engagement position. Conversely, when the user raises the actuation means 14, the second cam 142 comes into contact with the second actuation surface 1341, and then pushes the longitudinal stop element 13 towards its inactive position. During this phase, the first cam 141 moves away from the first actuation surface 1322 so as to no longer be in contact.

Due to this kinematics, the actuating means 14 acts directly on the longitudinal stop element 13 via the cams 141, 142. This makes it possible to exert a balanced force, with good efficiency, on the actuating means 14, which makes it possible to actuate the longitudinal stop element 13, without excessive force, even if jammed by wedges of snow, ice or the like. The operation of the longitudinal adjustment mechanism is more reliable, whether for locking or unlocking it.

Furthermore, the first cam 141 and the first actuation surface 1322 are dimensioned and arranged so that, when the longitudinal stop element 13 is in its active position and the actuating means 14 is in its engagement position, an action on the longitudinal stop element 13 to make it switch to its inactive position causes the rotation of the actuating means 14 in its direction of engagement. However, when in its engagement position, the actuating means 14 abuts against the upper front surface 116 of the frame 11. Consequently, the rotation of the actuating means 14 is blocked in this direction of rotation. The design therefore enables the longitudinal stop element 13 to be locked in its active position. The longitudinal stop element cannot therefore switch to its inactive position by a direct action on the longitudinal stop element. This configuration change is only possible via the actuating means 14. To obtain this characteristic, these parts are designed so that, when the longitudinal stop element 13 is in its active position and the actuating means 14 is in its engagement position, the direction N normal to the line of contact between the first cam and the first actuation surface is distant from the axis of rotation Y14 of the actuating means 14, so that a bottom-to-top vertical force exerted on the longitudinal stop element 13 causes the rotation of the actuating means 14 in its direction of engagement. Here, the direction N is offset rearward in relation to the axis of rotation Y14 of the actuating means 14.

In this example, the through opening 114 of the frame 11 is positioned between the walls 1171 of the yoke 117.

In this example, the pivot shaft 15, assembled to the yoke 117 of the frame 11, passes through the through holes 1441 of the radial extensions 144 of the actuating means 14, but also through the oblong opening 1332 of the central rib 133 of the longitudinal stop element 13 so that, when the longitudinal stop element 13 moves vertically, the pivot shaft 15 moves along the oblong opening 1332. Thus, the pivot shaft 15 also constitutes a guide means, as defined above. Similarly, the oblong opening 1332 also constitutes a complementary guide means, as defined above. The use of the same pivot shaft 15 for assembling a plurality of components of the retaining device, and more particularly of the actuating means 14 and of the longitudinal stop element 13, contributes to the compactness of the retaining device.

In this example, the pivot shaft 15, assembled to the yoke 115 of the frame 11, passes through oblong holes 1221 arranged on front extensions of the body of the movable jaw 122. These oblong holes 1221 are through along a transverse axis Y and extend along an axis X, so as to guide the longitudinal translation of the movable jaw. Furthermore, each first end of the connecting rods 124 of the holding mechanism 12 is rotatably mounted on this pivot shaft 15 and, therefore, about a transverse axis Y124 positioned in the front portion 117 of the frame 11, as indicated above. The second end of the connecting rods 124 is rotatably mounted on a lateral edge of the actuating lever 123 of the holding mechanism 12. This solution makes it possible to have a compact and economical construction, with a reduced number of parts. Here, the pivot shaft 15 performs several functions, the pivot axis Y14 of the actuating means 14, the vertical guiding of the longitudinal stop element 13, the longitudinal guiding of the movable jaw 122, the axis of rotation Y124 of the connecting rods 124.

In this example, the frame 11, the actuating lever 123 of the holding mechanism 12, the longitudinal stop element 13 and the actuating means 14 are dimensioned and arranged so that the longitudinal stop element 13 and the actuating means 14 can be housed within a recess 1231 provided inside the actuating lever 123 of the holding mechanism 12, when the latter is lowered to come against the upper surface 116 of the frame 11. Thus, the actuating lever 123 is sized to cover the longitudinal stop element 13 and the actuating means 14 when the boot is held in position in relation to the frame. In this configuration, the actuating means 14 is in its engagement position. This construction makes it possible to protect the longitudinal stop element 13 and the actuating means 14 from external elements when the user is skiing, which improves the reliability of the longitudinal adjustment mechanism. Indeed, the risk of the mechanism being blocked by wedges of snow, ice, or the like is limited. In addition, the actuating lever 123 also protects the mechanism against the risk of involuntary manipulation of the actuating means 14. Indeed, by being inaccessible when the boot is connected to the holding mechanism, the actuating means cannot be manipulated. There is therefore no risk that the user or an external element, a ski, a boot, a branch or the like will inadvertently actuate the actuating means.

Advantageously, the actuating lever 123 and the actuating means 14 are sized and arranged so that the actuating lever 123 can cooperate with the actuating means 14 so that, when the user lowers the actuating lever 123, the actuating means 14 is caused to switch to its engagement position, and when the actuating lever 123 is in contact against the upper surface 116 of the frame 11, the actuating means 14 is in its engagement position. This solution makes the practice safe because the user is then sure to have a locked longitudinal position when the boot is connected to the holding mechanism. In this example, the lowering of the actuating lever 123 is obtained by the contact between an inner surface 1232 of the recess 1231 and the upper surface 1432 of the gripping plate 143.

Advantageously, the actuating lever 123 and the longitudinal stop element 13 are dimensioned and arranged so that, when the actuating lever 123 is lowered (engagement position), an inner surface 1232 of the recess 1231 is flush with an upper surface 135 of the longitudinal stop element 13 so that the displacement of the longitudinal stop element 13 from its active position towards its inactive position is blocked by the contact between the upper surface 135 of the longitudinal stop element 13 and the inner surface 1232 of the recess 1231.

In this example, the longitudinal stop element 13 is actuated by an actuating means 14 independent of the holding mechanism 12. This construction makes the longitudinal adjustment mechanism reliable because it does not depend on the state of the holding mechanism. The user can take off the gliding apparatus without risk of losing the longitudinal adjustment of the binding.

In this example, the central rib 133 of the stop element 13 is housed within the central recess 1442 defined by the radial extensions 144 of the actuating means 14. This arrangement contributes to the compactness of the retaining device. Furthermore, the central rib 133 of the stop element 13 is also housed between the two walls 1171 of the yoke 117 of the frame 11, just like the radial extensions 144 of the actuating means 14. This arrangement also contributes to the compactness of the retaining device.

According to one embodiment, the retaining device is directly fixed to the gliding board, without a separate interface part. In this case, the upper surface of the ski incorporates the elements enabling the assembly of the retaining device on the ski.

It is possible to envision other embodiments of the mechanism for holding a fastening element belonging to the shoe in position. For example, the movable jaw can be positioned rearward on the retaining device in relation to the fixed jaw. The holding mechanism may not have a fixed jaw. For example, the movable jaw can be formed by two transversely movable spikes, arranged symmetrically with respect to the longitudinal median plane of the ski, each spike being capable of cooperating with a housing provided on a lateral edge of the front of the sole of the boot. Such a construction is illustrated, for example, in the patent document EP-A-0199098. Similarly, other actuating member solutions can be envisioned. This can be a rotary button or a push button.

According to the embodiments described above, the displacement of the longitudinal stop element 13 is achieved solely by the action of the actuating means 14, without the longitudinal stop element 13 being biased by any elastic means.

According to one embodiment, the longitudinal stop element 13 is coupled to an elastic means interposed between the longitudinal stop element and the frame or a part affixed to the frame so as to cause the displacement of the longitudinal stop element from its active position towards its inactive position. In this case, the actuating means makes it possible to maintain the longitudinal stop element in its active position. There would no longer be a need for a second cam. Indeed, as soon as the first cam no longer cooperates with the first actuation surface, the elastic means would make it possible to bring the longitudinal stop element towards its inactive position. It is preferable to provide an abutment for the longitudinal stop element to limit its displacement when it moves away from its active position. The inactive position would thus correspond to the position of the longitudinal stop element when it reaches the abutment. This construction facilitates the disengagement of the indexing means with the complementary indexing means; this reduces the risk of blockage. In addition, it allows having a stable disengaged configuration of the longitudinal stop element during displacement of the retaining device at the time of adjustment.

According to one embodiment, the longitudinal stop element 13 is coupled to an elastic means interposed between the longitudinal stop element and the frame or a part affixed to the frame so as to cause the displacement of the longitudinal stop element from its inactive position to its active position. In this case, the actuating means serves to disengage the longitudinal stop element from its active position. There would no longer be a need for a first cam. The construction would be similar to that described previously except that the actuating means would not have a first cam and the first actuation surface could serve as a support for the elastic means (other alternative solutions could be envisioned for positioning the elastic means). Indeed, as soon as the second cam no longer cooperates with the second actuation surface, the elastic means would make it possible to bring the longitudinal stop element towards its active position. It is preferable to provide an abutment for the longitudinal stop element to limit its displacement when it moves away from its inactive position. The active position would thus correspond to the position of the longitudinal stop element when it reaches the abutment. This construction facilitates the engagement of the indexing means with the complementary indexing means. In addition, this makes it possible to have a stable engaged configuration of the longitudinal stop element when it is no longer in an adjustment configuration. This secures the adjustment; if the actuating means is no longer operational, there is greater confidence that the longitudinal position of the retaining device is locked. As a variant, the device comprises such an elastic means and an actuating means provided with a first cam. In this case, the cam would enable the longitudinal stop element to be locked in its active position.

The invention is not limited to these embodiments. It is possible to combine these embodiments.

The invention is not limited to the embodiments described above but extends to all the embodiments covered by the appended claims.

Further, at least because the various configurations and details of the invention are disclosed herein in a manner that enables one to make and use the invention as described and shown, such as for simplicity or efficiency, for example, the invention can be practiced in the absence of any additional element or additional structure that is not specifically disclosed herein.

REFERENCES

1—Retaining device (or a Binding)
- 11—Frame
  - 111—Lower surface
  - 112—Edge
  - 113—Inner side groove
  - 114—Through opening
  - 115—Vertical extension
  - 116—Upper surface
  - 117—Yoke
    - 1171—Wall
- 12—Holding mechanism (or Holder)
  - 121—Fixed jaw
  - 122—Movable jaw
    - 1221—Oblong hole
  - 123—Actuating lever
    - 1231—Recess
    - 1232—Inner surface
  - 124—Connecting rod
- 13—Longitudinal stop element (or Longitudinal stop)
  - 131—Indexing means (or Indexer)
    - 1311—Notch
  - 132—Plate
    - 1321—Lower surface
    - 1322—Upper surface/First actuation surface
  - 133—Central rib
    - 1331—Lateral surface
    - 1332—Oblong opening
    - 1333—Front surface
  - 134—Upper extension
    - 1341—Lower surface/Second actuation surface
  - 135—Upper surface
- 14—Actuating means (or Actuator)
  - 141—First cam
  - 142—Second cam
  - 143—Gripping plate
    - 1431—Lower surface
    - 1432—Upper surface
  - 144—Radial extension
    - 1441—Through hole
    - 1442—Central recess
- 15—Pivot shaft
- 16—Return means (or Return)

2—Interface
- 20—Complementary indexing means (or Complementary indexer)
- 21—Main body
  - 211—Upper surface
  - 212—Central portion
    - 2121—Housing
  - 213—Lateral wing
- 22—Insert
  - 221—Upper surface
  - 222—Notch

3—Gliding board
- 31—Gliding surface
- 32—Upper surface

4—Gliding apparatus

5—Boot
51—Fastening element (or Fastener)
52—Sole

The invention claimed is:

1. Binding for retaining a boot on a gliding board, the binding comprising:

a frame configured to cooperate with an interface affixed to the gliding board so as to be capable of slide longitudinally with respect to the gliding board;

a longitudinal stop comprising an indexer and a first actuation surface, the longitudinal stop being carried by the frame and mounted translationally movable in relation to the frame, along a substantially vertical direction, between two configuration positions:

an active position for which the indexer is capable of cooperating with a complementary indexer affixed to the gliding board in order to immobilize the binding with respect to the gliding board in one of a plurality of predetermined longitudinal positions; and an inactive position for which the indexer does not cooperate with the complementary indexer;

an actuator comprising a first cam configured to interact with the first actuation surface of the longitudinal stop so as to cause the translation of the longitudinal stop towards its active position when the actuator is manipulated along one direction, the actuator being carried by the frame and movably mounted in relation to the frame between:

an engagement position for which the first cam acts on the first actuation surface to maintain the longitudinal stop in its active position; and a disengagement position for which the first cam does not act on the first actuation surface to maintain the longitudinal stop in its active position, wherein the actuator is configured to be movably mounted only in rotation in relation to the frame.

2. Binding according to claim 1, wherein:

the frame carries a holder configured to cooperate with a fastener belonging to the boot, so that the boot is held in position in relation to the frame; and the actuator is a component separate from the components of the holder.

3. Binding according to claim 2, wherein:

the holder is configured to enable the fastener to be affixed to the binding while allowing the rotation of the boot about an axis transverse to the binding.

4. Binding according to claim 2, wherein:

the holder comprises an actuating lever dimensioned to cover the longitudinal stop and the actuator when the boot is held in position in relation to the frame.

5. Binding according to claim 1, wherein:

the actuator comprises a gripping plate and at least one radial extension extending from the plate towards the axis of rotation of the actuator, the radial extension carrying the first cam.

6. Binding according to claim 5, further comprising:

two parallel radial extensions, spaced from one another along a transverse direction.

7. Binding according to claim 5, wherein:

the median plane of the gripping plate and the median plane of the frame are substantially merged when the binding is assembled.

8. Binding according to claim 7, wherein:

the longitudinal stop comprises a second actuation surface; and the actuator comprises a second cam capable of interacting with the second actuation surface of the longitudinal stop so as to cause the translation of the longitudinal stop towards its inactive position.

9. Binding according to claim 8, wherein:

the second actuation surface is opposite the first actuation surface.

10. Binding according to claim 8, wherein:

the actuator comprises a gripping plate and at least one radial extension extending from the plate towards the axis of rotation of the actuator, the radial extension carrying the first cam; and the at least one radial extension carries the second cam.

11. Binding according to claim 1, wherein:

the indexer is dimensioned and arranged so that, when the longitudinal stop switches to its inactive position, the indexer retracts into the frame.

12. Binding according to claim 1, wherein:

the translation of the longitudinal stop in relation to the frame is guided by the cooperation between a pivot shaft of the actuator and an oblong opening of the longitudinal stop.

13. Binding according to claim 1, wherein:

the displacement of the longitudinal stop is obtained solely by the action of the actuator without the longitudinal stop being biased by any elastic.

14. Binding according to claim 1, wherein:

the longitudinal stop is coupled to an elastic interposed between the longitudinal stop and the frame or a part affixed to the frame so as to cause the displacement of the longitudinal stop from its active position to its inactive position, or vice versa.

15. Gliding apparatus comprising:

a gliding board; and a binding for retaining a boot on the gliding board, the binding comprising:

a frame configured to cooperate with an interface affixed to the gliding board so as to be capable of slide longitudinally with respect to the gliding board;

a longitudinal stop comprising an indexer and a first actuation surface, the longitudinal stop being carried by the frame and mounted translationally movable in relation to the frame, along a substantially vertical direction, between two configuration positions:

an active position for which the indexer is capable of cooperating with a complementary indexer affixed to the gliding board in order to immobilize the binding with respect to the gliding board in one of a plurality of predetermined longitudinal positions; and an inactive position for which the indexer does not cooperate with the complementary indexer;

an actuator comprising a first cam configured to interact with the first actuation surface of the longitudinal stop so as to cause the translation of the longitudinal stop towards its active position when the actuator is manipulated along one direction, the actuator being carried by the frame and movably mounted in relation to the frame between:

an engagement position for which the first cam acts on the first actuation surface to maintain the longitudinal stop in its active position; and a disengagement position for which the first cam does not act on the first actuation surface to maintain the longitudinal stop in its active position;

wherein the actuator is configured to be movably mounted only in rotation in relation to the frame.

* * * * *